United States Patent [19]

Porter

[11] Patent Number: 4,949,654

[45] Date of Patent: Aug. 21, 1990

[54] INCINERATOR FOR COMBUSTING SEWAGE

[76] Inventor: Wilson L. Porter, 220 John Phillips Rd., Cedartown, Ga. 30125

[21] Appl. No.: 335,036

[22] Filed: Apr. 7, 1989

[51] Int. Cl.[5] ..... A47D 36/00; A47D 36/24

[52] U.S. Cl. ..... 110/216; 110/238; 110/346

[58] Field of Search ..... 110/346, 238, 246; 4/131

[56] References Cited

U.S. PATENT DOCUMENTS

| | | | |
|---|---|---|---|
| 2,882,534 | 4/1959 | Jauch et al. | 4/131 |
| 3,413,937 | 12/1968 | Bojner et al. | 110/246 |
| 3,765,035 | 10/1973 | Murchler | 4/131 |
| 4,437,418 | 3/1984 | Guillaume et al. | 110/246 |

*Primary Examiner*—Edward G. Favors

*Attorney, Agent, or Firm*—Jones, Askew & Lunsford

[57] ABSTRACT

An incinerator apparatus for combusting liquid and solid sewage waste, having a holding tank to receive sewage from a toilet, a pump to communicate sewage to a cylindrical rotary kiln, a flame source located at an upstream end of the kiln, a compressor to blow high pressure, high velocity air through the rotary kiln, a cone cantilever mounted along the longitudinal axis of the kiln with the small end pointed toward the flame source, a stainless steel mesh sponge attached to the heated air discharge to filter gases and to catch and combust fly ash and combustible gases, the cone directing the flames toward the interior wall of the kiln.

21 Claims, 2 Drawing Sheets

INCINERATOR FOR COMBUSTING SEWAGE

TECHNICAL FIELD

The present invention relates to incinerators. More particularly, the present invention relates to a compact incinerator for pleasure boats to receive and combust sewage wastes in a combustion chamber.

BACKGROUND OF THE INVENTION

Treatment of collected sewage has become increasingly important in recent years. Generally, the public and various regulatory authorities increasingly believe that the environment is less able than was previously thought to naturally filter and purify itself from the myriad of pollutants dicharged from manufacturing facilities, cities, and other installations. One area of particular concern is disposal of sewage from pleasure craft operating on various lakes, rivers, and ocean water ways.

Owners and operators of boats and marinas are coming under increasing governmental regulation, particularly in the control of how boating activities impact the environment. Indiscriminate discharge of sewage into water ways is becoming more restricted. United States Coast Guard regulations govern discharges from boats. In many circumstances, these regulations restrict operators of pleasure craft from discharging effluents except into approved sanitary systems. Marine toilets on houseboats and other pleasure craft thus include holding tanks to receive sewage. The boat holding tanks may be purged at marinas or other facilities equipped with sanitary systems to receive and treat such waste. Such treatment systems however may have insufficient capacity for the increased demand arising from regulations which restrict dumping.

Typical marine toilets with holding tanks include a liquid chemical to provide initial disinfecting treatment of the waste, to reduce noxious odors and to maintain the sanitation of the marine toilet. Chemical treatment of waste in the holding tank is a temporary solution. The waste must still be transferred to an approved treatment facility.

Incineration of sewage provides an alternative to holding the waste materials for entry to a standard sewage treatment system. U.S. Pat. No. 2,882,534 describes an incinerator toilet having a sealable receptacle assembly which functions as a commode and treatment apparatus. A flame is dischargd from an ignition unit and a stream of high velocity air carries the flame inward and downward through a mixing tube into the incineration chamber. The flame is in direct contact with the waste. An agitator is rotated to break up solids in the waste and agitator rods expose particles of sewage to the hot flame. The liquids are vaporized and the solids are burned. Gases are discharged through a stack to the atmosphere. A latch member and a lock restrict the toilet from use while wastes are being combusted. After combustion and agitation stops, a blower continues to move air through the receptacle assembly for cooling. A thermal switch releases the lock when the temperature drops to a predetermined point permitting the toilet to be used again.

U.S. Pat. No. 3,765,035 describes a disposal system which dries and sterilizes sewage. Sewage collected from various receptacles is transferred through a conduit to a rotatable sphere. A gas heater is mounted within the sphere and includes a deflector plate or cone.

The sphere rotates with a driving gear and it is heated to dry and sterilize the sewage. Muller balls of varying diameters roll about the bottom of the sphere to mash and squeeze the solid waste material. A vacuum pump removes vapors from the sphere. Residual solids are periodically removed from the sphere. Reversing the vacuum pump provides air pressure to expel the powders or solids into a tank, drum or other storage device.

Each of these described apparatus have drawbacks and disadvantages which limit their practicality for use on pleasure craft. Because space on pleasure craft and houseboats is at a premium, the marine toilet is typically placed in a small area. A complicated and bulky marine toilet with an integrated incinerator occupies space more valuable for other purposes. Also, a toilet facility on a boat which includes an integral incinerator would require special construction to receive and house the incinerator/toilet. Such construction includes triple wall framing to provide an interface between the incinerator and the area of the pleasure craft in which the apparatus is installed. Operation of the incinerator requires time for pre-heating and cooling. It is more economical to incinerate sewage which first accumulates in a holding tank. A holding tank also permits the marine toilet to remain available for use. Rather than using a spherical holding tank as a drying chamber, measured transfer of sewage into the incinerator provides more efficient and thorough combustion of the sewage.

The apparatus which uses a vacuum pump to remove vapors increases the complexity of the incinerator. Further, such a drying-type incinerator does not completely combust the waste particles and requires routine removal and disposal of residual solids. Accordingly, there is a need in the art to provide a environmentally acceptable compact sewage treatment apparatus for marine toilets.

BRIEF SUMMARY OF THE INVENTION

The present invention solves the above-described problems by providing a compact incinerator for combusting sewage. In general, the present invention transfers sewage from a marine toilet to a chamber for combustion. More particularly described, the present invention includes a holding tank which receives the sewage from a marine toilet. A pump, activated periodically by an intermittent timer, transfers the sewage from the holding tank to a combustion apparatus which includes a rotatable cylindrical kiln. High temperature flames flood the kiln to heat the walls of the kiln. A cone is disposed coaxial with the kiln to direct the hot flames against the kiln wall. The sewage drips into the kiln and combusts by exposure to the flames and the heated kiln. A wire mesh filter is heated by the exhaust gases flowing from the combination chamber to the atmosphere. The filter traps and combusts minute particles which travel with the exhaust gases.

The problems and disadvantages of previously known apparatuses are overcome by the compact incinerator of the present invention. The incinerator is installable remote from the marine toilet itself, thereby eliminating the need for special construction in the toilet facility of the boat.

The sewage is accumulated in a holding tank for periodic delivery to the incinerator. The marine toilet remains available for use. Measured delivery of sewage to the incinerator permits extensive evaporation and combustion by direct exposure of the sewage to the flames. This substantially eliminates noxious odors and reduces residual solids to a minimum. A separate system for removal of combustion by-products is not necessary.

Accordingly, it is an object of the present invention to provide a compact incinerator which combusts sewage materials.

It is another object of the present invention to provide a compact incinerator which receives sewage into a rotary kiln and exposes the sewage to flames for combustion.

It is another object of the present invention to provide a compact incinerator which minimizes discharge of particulate matter.

It is another object of the present invention to provide a combustion incinerator which filters exhaust gases vented to the atmosphere.

It is another object of the present invention is to provide a compact incinerator which filters exhaust gases by combusting residual combustibles.

It is another object of the present invention to provide a compact incinerator which evaporates liquids and burns solid waste materials.

It is another object of the present invention to provide a compact incinerator which exposes the sewage to the direct flame and hot gases of combustion.

It is another object of the present invention to provide a compact incinerator which agitates the waste in a combustion chamber.

It is another object of the present invention to provide a compact incinerator which heats the incinerator by directing flames from a flame source to the incinerator wall.

It is another object of the present invention to provide a compact incinerator for treating waste on pleasure craft.

It is another object of the present invention is to provide a compact incinerator which reduces the volume of solid particulates remaining from treated sewage.

It is another object of the present invention is to provide a compact incinerator which reduces noxious gas discharges from sewage treatment apparatus.

Still other objects, features, and advantages will become apparent upon reading of the following detailed description in conjunction with the drawings and the appended claims.

DETAILED DESCRIPTION OF THE PREFERRED EMBODIMENT

Figure 1:
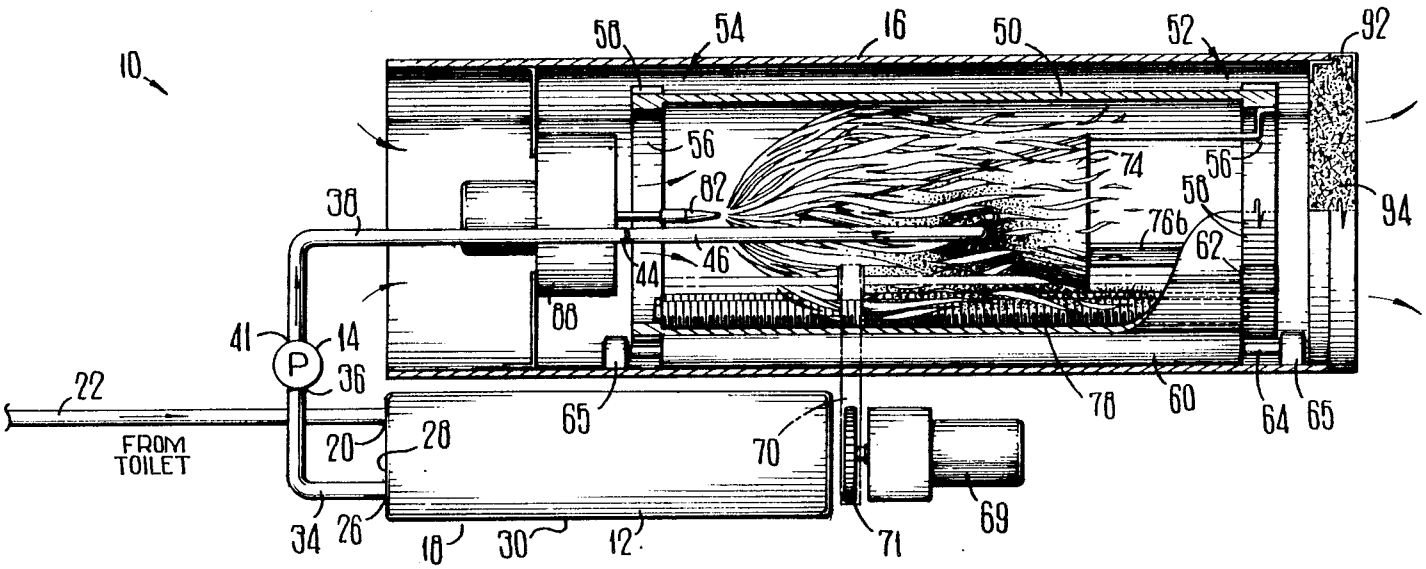
FIG. 1 is a cross sectional view of a disclosed embodiment of the incinerator according to the present invention.

Referring now in more detail to the drawings, in which like numerals indicate like parts throughout the several views, FIG. 1 illustrates a cross sectional view of a preferred embodiment of the incinerator 10 according to the present invention. The incinerator 10 includes a sewage holding tank 12, a pump 14, and a housing 16. The holding tank 12, the pump 14, and the housing 16 mount in a frame 18 (illustrated in FIG. 2). The holding tank 12 and the pump 14 attach to the frame below the housing 16.

A rotatable cylindrical kiln 50 lies within the housing 16. In a preferred embodiment, the longitudinal axis of the cylindrical kiln 50 is horizontal. The kiln 50 includes a discharge end 52 and a flame end 54. Both the discharge end 52 and the flame end 54 of the cylindrical kiln 50 are open. The ends 52 and 54 each include an annular ring 56 with a plurality of gear teeth 58.

The holding tank 12 includes an inlet 20 adjacent the tank's upper surface. The inlet 20 receives a first hose 22. Sewage is introduced into the holding tank 12 through the first hose 22. The inlet 20 includes a coupling (not shown) which receives one end of the first hose 22. The other end of the first hose 22 connects to the marine toilet (not shown). The side 28 includes an outlet port 26 adjacent the bottom 30 of the holding tank 12. A second hose 34 attaches to the outlet port 26 and connects the holding tank 12 with the pump 14. The pump 12 has an intake 36 which receives the other end of the hose 34.

Figure 2:
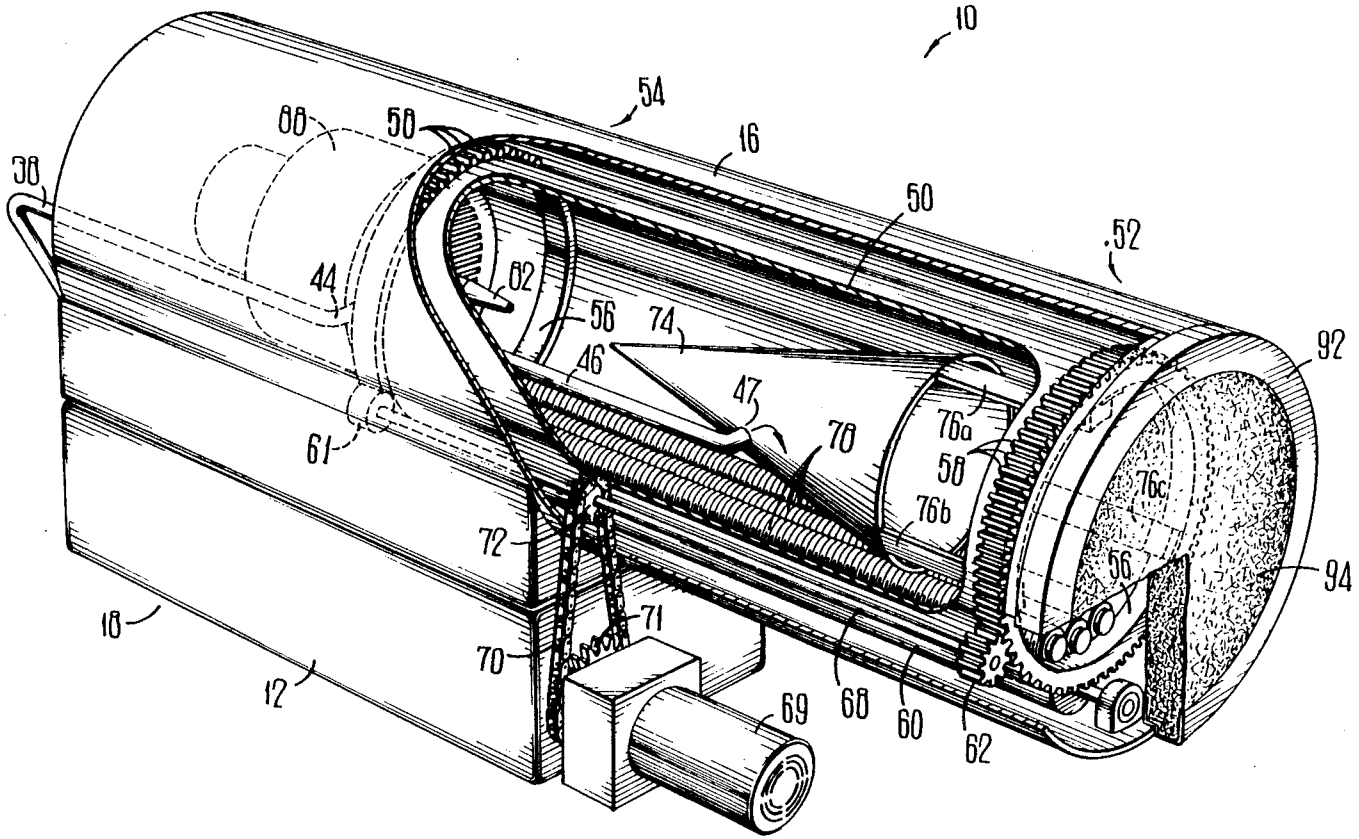
FIG. 2 is a perspective view illustrating the gear drive and flame spreader cone in the disclosed embodiment of the present invention.

An end 40 of a third hose 38 connects to a discharge port 41 of the pump 12. The third hose 38 extends upwardly and longitudinally along the incinerator housing 16. A second end 44 of the third hose 38 joins a metal tube 46 which protrudes through an interior wall (not illustrated) of the incinerator housing 16. The metal tube 46 has an outlet end 47. As shown in FIG. 2, the metal tube 46 penetrates the housing wall between the longitudinal ends of the housing 16 and near the flame end 54 of the kiln 50. A bend permits the tube 46 to extend parallel to the longitudinal axis of the kiln 50 through the open flame end 54 and into the kiln 50. In the illustrated embodiment, the metal tube 46 extends approximately horizontally adjacent the longitudinal axis of the housing 16, but the vertical positioning of the tube may range from above to below the horizontal plane through the axis.

A roller 60 and two drive gears 61 and 62 support the cylindrical kiln 50 in the housing 16. The roller 60 lies on one side of the lower portion of the housing 16, with its longitudinal axis parallel to the longitudinal axis of the kiln 50. The outer surface of the cylindrical 50 contacts the roller 60. The roller 60 connects to and rotates around a shaft 64. A pair of bearing support flanges 65 support the shaft 64. One bearing support flange 65 mounts in the lower portion of the housing 16 near the discharge end 52 of the cylinder 50. The shaft 64 engages a bearing in the support flange 65 in a conventional manner. The other end of the shaft 64 also engages a bearing in the second bearing support flange (not illustrated) which mounts in the lower portion of the housing 16 near the flame end 54. The bearings permit the roller 60 to rotate on the shaft 64.

The two drive gears 61 and 62 also are disposed in the lower portion of the housing 16, but on the side laterally opposite the roller 60. The gear 62 is located near the discharge end 52 of the kiln 50 and the gear 61 is near the flame end 54. The teeth of the drive gears 61 and 62 engage the gear teeth 58 of the respective annular rings 56. The roller 60 and the drive gears 61 and 62 thus provide three supports for the rotatable cylindrical kiln 50.

Both drive gears 61 and 62 mount on a common drive shaft 68. A motor 69 rotates the drive shaft 68. In the illustrated embodiment, the motor 69 mounts to the flame 18 adjacent the holding tank 12. A chain 70 couples the drive shaft 68 to the motor 69. The chain 70 passes around a sprocket 71 on the motor 69 and a sprocket 72 connected to the drive shaft 68. Appropriate flanges (not illustrated) mount to the housing 16 to support the drive shaft 68 adjacent the sprocket 72. In an alternate embodiment, one end of the drive shaft 68 connects directly to the motor 69 which mounts to the frame 18.

The incinerator 10 also includes a flame spreader cone 74. The flame spreader cone 74 is coaxially disposed within the cylindrical kiln 50 by cantilever attachment to the kiln 50 at the discharge end 52. The small end of the cone 74 points toward the flame end 54. Three flanges 76*a*, 76*b* and 76*c* connect at a first end of each flange 76 to the interior of the cylindrical kiln 50 at the discharge end 52. The flanges 76 in the illustrated embodiment are equally spaced circumferentially around the annular opening of the kiln 50. The flanges 76 extend toward the flame end 54 of the kiln 50. The second end of each of the three flanges 76 connect to the large end of the cone 74. The metal tube 46 is longitudinally disposed between the wall of the kiln 50 and the cone 74. The outlet 47 of the tube 46 is positioned over the cone surface and spaced away from a vertical plane passing through the longitudinal axis of the kiln 50.

A plurality of rollers 78 are loosely placed inside the kiln 50. The longitudinal axis of each roller 78 is parallel to the longitudinal axis of the kiln 50. In a preferred embodiment, the rollers are threaded rods. The threads pick up and expose the sewage to the flames and heat.

A burner 82 mounts in the flame end 54 of the housing 16 and connects to a fuel supply (not shown). The burner 82 is positioned in front of a discharge port 86 of a fan 88.

The discharge end 52 of the housing 16 includes an annular filter frame 92. The frame 92 attaches conventionally to the housing 16, such as with screws or bolts. The filter frame 92 holds a filter 94. In the disclosed embodiment, the filter 94 is made from fine stainless steel mesh.

The sewage holding tank 12, the pump 14, and the motor 69 are mounted conventionally to the frame 18. The first hose 22 is connected between the inlet 20 of the holding tank 12 and the marine toilet. The second hose 34 is connected between the outlet port 26 and the intake 36 of the pump 12.

The incinerator housing 16, which includes the burner 82 and an air fan 88, is mounted to the top of the flame 18. The shaft 64 including the roller 60 is rotatably connected at its ends to the bearings in the support flanges 65 in the lower portion of the housing 19. The sprocket 72 is connected to the drive shaft 68 and the drive gears 61 and 62 are connected to the longitudinal ends of the drive shaft 68. The chain 70 passes around the sprocket 72 on the drive shaft 68 and the sprocket 71 on the motor 69. The motor 69 then is secured to the frame 18 so that the chain 70 is sufficiently tight around the sprockets 71 and 72.

The annular sprocket rings 56 are attached to the discharge end 52 and the flame end 54 of the kiln 50. Three flanges 76 are connected at a first end of each flange to the interior of the kiln 50 at the discharge end 52. The second end of each of the three flanges 76 is connected to the large end of the cone 74 to hold the cone 74 coaxial with the cylindrical kiln 50.

The cylindrical kiln 50 is secured within the housing 16 with the rollers 78 placed inside of the kiln. The gear teeth on the sprocket 56 engage the gear teeth of the drive gears 61 and 62 and the outside surface of the kiln 50 rests on the roller 60. The metal tube 46 is inserted through a hole in the side wall of the housing 62. The tube 46 is positioned through the open flame end 54 of the kiln 50, adjacent the longitudinal axis of the kiln 50 and between the cone 74 and the inner wall surface of the kiln 50. The outlet 47 is spaced away from the surface of the cone 74 and the interior wall surface of the kiln 50. The third hose 38 is connected between the discharge port 41 of the pump 12 and the tube 46 protruding from the wall 48 of the housing 16.

A controller (not shown) is mounted to the frame 18. Control cables are wired from the controller to the pump 14, to the motor 69, and to the burner 82. In one embodiment, the controller is an interval timer. The timer activates and stops the pump 14, the motor 69, and the burner 82 in appropriate sequence to combust the sewage.

In operation, the holding tank 12 receives sewage from the marine toilet. After an appropriate quantity of sewage is accumulated in the holding tank 12, the incinerator 10 is operated. In one embodiment, the incineration cycle is commenced by manually activating the controller. In an alternate embodiment, the controller monitors the accumulation in the holding tank and commences the incineration cycle as needed.

In a preferred incineration cycle, the controller activates the fan 88 to blow air through the combustion chamber 16. The motor 69 is started to begin rotating the cylindrical kiln 50. The gears 61 and 62 are turned by the drive shaft 68 which is connected by the chain 70 to the sprocket 71. The kiln 50 is rotated because the teeth of the annular sprockets 56 are engaged by the teeth on the gears 61 and 62. The roller 60, contacted by the outer surface of the kiln 50, is turned freely in response to the rotation of the kiln 50. The burner 82 is ignited and flames flood the cylindrical kiln 50. The flames are directed toward the interior wall by the cone 74 to preheat the kiln 50.

After the kiln 50 is preheated, the pump 14 is started and sewage is delivered from the holding tank 12 into the rotating kiln 50. Preferably, the pump 14 uses a flexible impeller to wipe the walls of the pump chamber. The flow rate is adjusted so as not to overload the kiln 50. In a preferred embodiment, an interval timer cycles on and off to start and stop the pump 14. For instance, the interval timer cycles on for 5 seconds and off for 20 seconds. The sewage is dripped onto the rotating surface of the cone 74 and onto the interior wall of the kiln 50. The liquid portion is evaporated. The solid portion is combusted by the heat from the flames directed through the kiln 50. The threaded rollers 78 are freely turned as the kiln 50 is rotated by the drive gears 61 and 62. The threaded rollers 78 pick up liquids and solids from the bottom of the cylinder and expose the sewage to the flames and the hot gases of combustion.

The combustion gases and the particles are blown through the kiln 50 by the fan 88. The gases pass through the filter 94. In the preferred embodiment, the filter 94 is fine stainless steel mesh which glows red hot in the presence of the hot exhaust gases. The particles caught by the filter 94 are combusted by the extremely hot mesh filter.

When the sewage is emptied from the holding tank 12, or an appropriate period of time has passed, the cycle ends. One embodiment of the present invention, utilizing a 30,000 BTU burner, combusted approximately one gallon of sewage per hour. The interval timer controlling the pump 12 is stopped. The cylinder kiln 50, however, continues to rotate and the flame from the burner 82 is continued to combust any remaining waste. The fuel supply to the burner 82 is stopped and the flame goes out. The fan is operated to blow air through the incinerator 10 to cool the cylindrical kiln 50. Finally, the motor 69 is stopped.

One skilled in the art will appeciate that the marine toilet and the incinerator 10 may be remotely located. For instance, the marine toilet could be installed amidships on the boat with the holding tank 12 and the pump 14 nearby. The incinerator 10 would be located in another portion of the ship. In one embodiment, the incinerator 10 is mounted with the discharge end 54 on an exterior wall of the boat so that the hot gases of combustion are vented outside of the boat.

The principles, preferred embodiments, and modes of operation of the present invention have been described in the foregoing specification. The invention is not to be construed as limited to the particular forms disclosed, because these are regarded as illustrative, rather than restrictive. Moreover, variations and changes may be made by those skilled in the art without departing from the spirit of the invention as described by the following claims.

What is claimed is:

1. An incinerator for combusting waste materials, comprising:

a combustion chamber;

a source of flames located at an upstream end of the combustion chamber;

means for rotating the combustion chamber;

means for delivering waste to the interior of the combustion chamber, whereby the waste is introduced to the flames for incineration; and a cone coaxial with the combustion chamber having a small end adjacent the source of flames so as to direct the flames against the kiln wall.

2. The incinerator as recited in claim 1, further comprising means for combusting combustable matter carried in the gases vented from a discharge end of the combustion chamber.

3. The incinerator as recited in claim 2, wherein the said means for combusting comprises:

an annular ring which attaches to the discharge end of the combustion chamber; and a stainless steel mesh filter held by the annular ring.

4. The incinerator as recited in claim 1, wherein the means for delivering comprises a pump and an intermittent timer which cycles the pump on and off.

5. The incinerator as recited in claim 1, wherein the means for rotating comprises:

an annular ring mounted to each of an inlet end and the discharge end of the combustion chamber;

a roller which contacts an outer surface of the combustion chamber;

a pair of drive gears, each drive gear engaged to one of the annular rings; and a motor connected by a chain to a drive shaft to turn the drive gears.

6. The incinerator as recited in claim 5, further comprising means for controlling a combustion cycle.

7. The incinerator as recited in claim 6, wherein the means for controlling a combustion cycle is a timer which communicates on and off signals to the source of the flame, to the motor which rotates the combustion chamber, and to the pump which transfers the sewage.

8. The incinerator as recited in claim 1 further comprising a plurality of threaded rollers longitudinally disposed in the combustion chamber to turn as the combustion chamber rotates.

9. An incinerator for combusting waste materials, comprising:

a rotatable cylindrical combustion chamber having an inlet end and a discharge end;

a source of flame located at the inlet end;

a cone coaxial with the combustion chamber having a small end adjacent the source of flame for spreading the flames toward the combustion chamber wall;

a pair of annular sprockets mounted to the inlet end and the discharge end;

a pair of drive gears, one of the drive gears engaged to one annular sprocket;

means for rotating the drive gears;

an annular ring attached to the discharge end of the combustion chamber;

a stainless steel mesh filter held by the annular ring; and means for delivering waste from a waste receptacle to the interior of the combustion chamber, whereby the waste is introduced to the flame for incineration.

10. The incinerator as recited in claim 9 further comprising a housing which supports the combution chamber.

11. The incinerator as recited in claim 10 further comprising a roller having a longitudinal axis parallel to the longitudinal axis of the chamber, the roller rotatable about its longitudinal axis and disposed in a lower portion of the housing to support and rotate with the combustion chamber.

12. The incinerator as recited in claim 9 further comprising at least one threaded roller loosely disposed longitudinally in the combustion chamber and turning in response to the rotation of the combustion chamber to expose the waste directly to the flames.

13. A method of combusting waste materials, comprising:

communicating waste materials into an open ended combustion chamber;

flooding the combustion chamber with high temperature flames driven by a steam of high velocity air from a fan to expose the waste materials to the flames;

directing the high temperature flames toward the interior wall of the combustion chamber by a cone coaxially mounted within the combustion chamber; and filtering exhaust gases exiting from the combustion chamber.

14. The method of combusting waste materials as recited in claim 13 further comprising rotating the combustion chamber while the high temperature flames flood the chamber.

15. An incinerator for combusting waste materials, comprising:

a combustion chamber;

an annular ring which attaches to the discharge end of the combustion chamber;

a stainless steel mesh filter held by the annular ring;

a source of flames located at an upstream end of the combustion chamber;

means for rotating the combustion chamber; and means for delivering waste from a waste receptacle to the interior of the combustion chamber whereby the waste is introduced to the flames for incineration.

16. The incinerator as recited in claim 15, further comprising a plurality of threaded rollers longitudinally disposed in the combustion chamber and rotatable in response to rotation of the combustion chamber.

17. The incinerator as recited in claim 16, wherein the means for delivering comprises a pump and an timer which intermittently cycles the pump on and off.

18. The incinerator as recited in claim 15, wherein the means for delivering comprises a pump and an timer which intermittently cycles the pump on and off.

19. An incinerator for combusting waste materials, comprising:

a combustion chamber;

a source of flames located at an upstream end of the combustion chamber;

means for rotating the combustion chamber; and a pump for delivering waste from a waste receptacle through a pipe to the interior of the combustion chamber, and an timer which intermittently cycles the pump on and off, whereby the waste is introduced to the flames for incineration.

20. The incinerator as recited in claim 18, further comprising a plurality of threaded rollers longitudinally disposed in the combustion chamber and rotatable in response to rotation of the combustion chamber.

21. An incinerator for combusting waste materials, comprising:

a combustion chamber;

a source of flames located at an upstream end of the combustion chamber;

means for rotating the combustion chamber, a plurality of threaded rollers longitudinally disposed in the combustion chamber and rotatable in response to rotation of the combustion chamber; and means for delivering waste from a waste receptacle to the interior of the combustion chamber, whereby the waste is introduced to the flames for incineration.

* * * * *